United States Patent [19]

Gouttefangeas

[11] Patent Number: 4,932,549

[45] Date of Patent: Jun. 12, 1990

[54] CIRCULAR COVER FOR CONDITIONING VATS FOR BULK GOODS

[75] Inventor: Bernard Gouttefangeas, Villeurbanne, France

[73] Assignee: Sofratube RCT, S.A., Paris, France

[21] Appl. No.: 283,330

[22] PCT Filed: Mar. 2, 1988

[86] PCT No.: PCT/FR88/00117

§ 371 Date: Jan. 13, 1989

§ 102(e) Date: Jan. 13, 1989

[87] PCT Pub. No.: WO88/07007

PCT Pub. Date: Sep. 22, 1988

[30] Foreign Application Priority Data

Mar. 13, 1987 [FR] France ..... 87 03607

[51] Int. Cl.[5] ..... B65D 51/18

[52] U.S. Cl. ..... 220/254; 220/212; 220/307

[58] Field of Search ..... 220/212, 254, 287, 305, 220/306, 307, 320

[56] References Cited

U.S. PATENT DOCUMENTS

| | | | |
|---|---|---|---|
| 2,733,052 | 1/1956 | Luther | 220/254 X |
| 2,989,208 | 6/1961 | Gibbs, Jr. | 220/254 |
| 3,127,064 | 3/1964 | Fairchild | 222/153 |
| 3,424,340 | 1/1969 | Rocher | 220/320 |
| 3,437,254 | 4/1969 | Bergstrom | 229/5.7 |
| 3,572,540 | 3/1971 | La Croce | 220/254 |
| 3,606,074 | 9/1971 | Hayes | 220/212 |
| 3,907,156 | 9/1975 | Weatherhead | 220/307 |
| 3,998,354 | 12/1976 | Song | 220/254 X |
| 4,000,839 | 1/1977 | Tecco et al. | 220/254 X |
| 4,024,980 | 5/1977 | Kneusel et al. | 220/307 X |
| 4,667,842 | 5/1987 | Collins | 220/307 |
| 4,682,707 | 7/1987 | Wiles | 220/307 |
| 4,699,290 | 10/1987 | Adams | 220/254 X |
| 4,706,838 | 11/1987 | Von Holdt | 220/254 X |

FOREIGN PATENT DOCUMENTS

| | | |
|---|---|---|
| 1552622 | 1/1969 | France . |
| 2170298 | 9/1973 | France . |
| 2138384 | 10/1984 | United Kingdom . |

*Primary Examiner*—Stephen P. Garbe
*Assistant Examiner*—Nova Stucker
*Attorney, Agent, or Firm*—Sandler, Greenblum & Bernstein

[57] ABSTRACT

A cover having an exterior crown provided with a hole which is designed to be fixed onto an outer edge of a vat. The cover has a rigid inner capsule for blocking the hole. When the cover is in a final position, the inner capsule which is attached to the crown by a hooked locking device, is elastically engaged. The inner capsule also has a provisional position, in which it is placed in a movable position across the hole, in an inverted position. The cover can be easily removed and placed in its final position by an automatic vat filling installation. The cover is preferably manufactured from a synthetic substance, and has application in the field of conditioning bulk good, such as grains, powders or pastes.

9 Claims, 2 Drawing Sheets

CIRCULAR COVER FOR CONDITIONING VATS FOR BULK GOODS

The present invention relates to a circular cover for a bulk goods conditioning vat, comprising an exterior crown provided with an orifice and adapted to be affixed to an extreme edge of the vat, a rigid inner capsule adapted to be applied and affixed to this orifice so as to block it, and blocking means having hooks, positioned on the inner capsule and on the crown and engaging by elasticity to maintain the inner capsule in a blockage position on the crown in a manner so as to prevent a disengagement of the inner capsule under the effect of a force directed towards the exterior.

To close vats utilized for conditioning bulk goods present in the form of granules, powders, pastes or liquids, particularly for chemical products, food ingredients, plastic materials or glues, one frequently utilizes cylindrical or bulging vats whose one surface extremity is formed by a cover of the above type. These vats are often made of synthetic material, but can also be formed out of cardboard, metal or other materials The cover is affixed on the vat for transport and storage of the empty or full vat. Of course, it must be removed on the one hand for the filling and on the other hand for each removal of product in the vat, each time with a manipulation of the tightening collar guaranteeing the maintenance of the cover on the vat in a sealed manner, making it possible to assure good conditions of preservation of the products.

However, this type of closure of a vat has certain disadvantages, particularly within the framework of an automatic filling The tightening collar, which must be able to be opened and then subsequently closed manually, will not be able to be positioned except with difficulty by a machine, and this in a very costly manner and not really guaranteeing a sealed closure Once filled, the vat slightly deforms with respect to the empty state, such that the cover does not apply itself directly in the same manner in the two states. As a result, in most of the production lines where the products are placed in vats in an automatic manner, it is preferable to utilize covers made of two pieces comprising an exterior crown and a central inner capsule. The exterior crown being fixed in advance on the vat, the filling occurs through its orifice, which need only be subsequently blocked in a definitive manner by means of an inner capsule which one pushes simply into the orifice of the crown. Covers of this type, corresponding to the preamble of claim 1, are described in U.S. Pat. Nos. 3,127,064 and 3,907,157.

However, these known covers require the separate transport and storage of the inner capsules of the covers, as well as to introduce them separately in the vats in an automatic filling line, which complicates the organization of the conditioning line and increases its cost. Furthermore, as the inner liner is not in place on the cover before the filling, the vats remain open during all of their transport and their vacuum storage, such that they can become dirty or contaminated.

Consequently, the present invention aims to overcome these disadvantages by virtue of a cover that makes it possible to block a vat before its filling, then open it and automatically close the vat during its filling, all while assuring a proper sealing of the filled vat.

To this end, a the cover according to the invention is characterized in that the inner capsule and the crown comprise mutual a far sealing that maintains the inner capsule on the orifice of the crown in a removable manner, while permitting a disengagement of the inner capsule by a force directed towards the exterior of the vat, in a provisional position of the inner capsule where the blockage means are not engaged.

Preferably, in its provisional position, the inner capsule is positioned oppositely with respect to its blockage position. The inner capsule comprises preferably, at its periphery, an edge portion which is substantially flat, extending radially beyond the blockage means and cooperating with the sealing means.

In a first alternative, the sealing means comprise a continuous spur, or a row of spurs, which are positioned around the orifice on an upper oblique surface of the crown, in a manner so as to engage the edge of the inner capsule in the said provisional position.

In a second alternative, the sealing means comprises a circular groove provided in the side of the edge of the inner capsule, and a continuous or discontinuous bead adapted to engage in this groove at least the provisional position of the inner capsule and positioned on a zone of the crown which is radially elastic.

In another alternative, the inner liner and the orifice is circular, and the sealing means and the blockage means of the inner capsule are combined in a bayonet mechanism, the inner capsule passing from its provisional position to its blockage position by a rotation around its axis. In this case, it is thus not placed against its provisional position.

In a preferable embodiment of the blockage means, they comprise on the inner capsule a continuous or discontinuous edge having a hooked profile directed towards the periphery of the inner capsule, and on the crown an interior edge adapted to engage in this hook when the inner capsule is in the blockage position, this edge of the inner capsule and/or this interior edge of the crown being elastically deformable for the affixation of the inner capsule. Preferably, the crown comprises an oblique surface above the interior edge, and the edge of the inner capsule comprises a flexible sealing tongue which is applied elastically against this oblique surface when the inner capsule is in its blockage position.

Preferably, the crown and the inner capsule are made of a synthetic rigid and molded material. Furthermore, the exterior edge of the crown preferably comprises a rigid portion adapted to nest on the exterior surface of the extreme edge of the vat, and a thinner portion is flexible extending at rest in the extension of this rigid portion and adapted to be pressed back against the edge of the vat by a tightening collar.

The invention and its advantages will become clearer from the following description of embodiments, with reference to the annexed drawings, in which.

Figure 1:
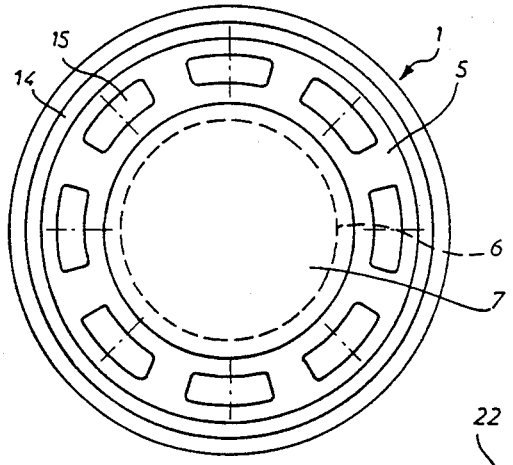
FIG. 1 is a planar view of one embodiment of a circular cover according to the invention, comprising a central orifice and an inner capsule which are likewise circular.
Figure 3:
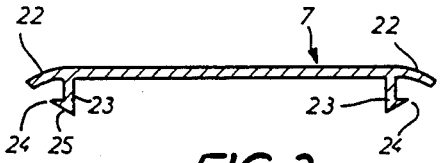
FIG. 3 is radial cross-sectional view of the inner capsule.
Figure 4:
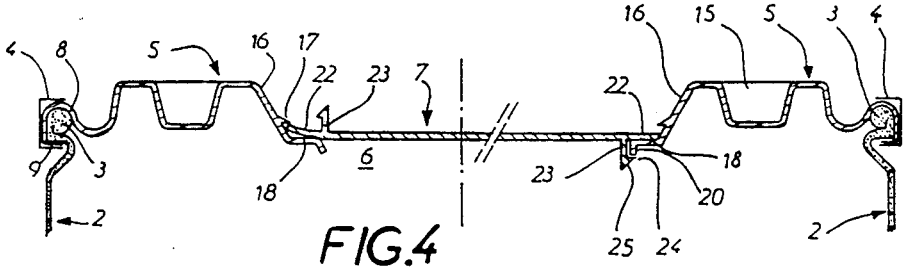
FIG. 4 is a radial cross-sectional view of the cover of FIG. 1, once placed in position on the vat, the left half of the figure showing the inner capsule in its provisional position, and the right half showing it in its blocking position.

A circular cover, 1 illustrated by FIGS. 1–4, is adapted to close the end of a vat 2 provided with an edge 3 on which the cover is maintained in a sealed fashion by means of a metallic tightening collar 4 of a known type, having a U-shaped profile, as shown in FIG. 4. Cover 1 comprises of a circular exterior crown 5 having a circular central orifice 6 and a circular inner capsule 7 formed of an element which is separated and adapted to block orifice 6 in two different positions, namely a provisional position and a blockage position, as will be described below. Preferably, the two elements 5 and 7 of the cover are made of a synthetic rigid molded material, such as polyvinyl chloride or a high density polyethylene.

Figure 2:
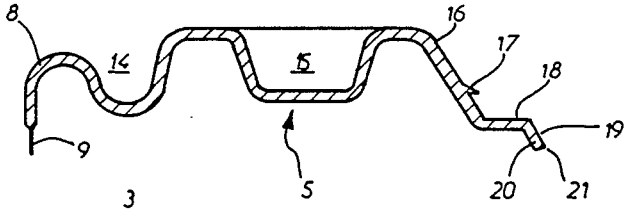
FIG. 2 is a partial radial cross-sectional view showing the profile of the crown of the cover in the free state, as well as the profile of the edge of the vat.
Figure 2:
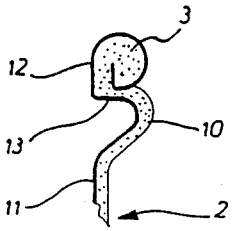

The profile of crown 5 appears in particular in FIG. 2. In this example, the edge of the crown comprises a relatively rigid portion 8 whose profile is rounded towards the bottom, this rigid portion being extended downwardly by an integrated hip-lead 9 which is thinner and flexible and which fills a sealing function This edge of the cover is adapted to be mounted in a sealed manner on the end bead 3 of the vat, having a known shape, illustrated for example in FIG. 2. In the present case, it is a vat 2 having a wall made out of cardboard 10 whose end is reinforced by a metallic ring 11 folded around cardboard to form the edge 3, by forming in particular on this edge an exterior cylindrical surface 12 and a lower horizontal or slightly inclined surface 13. As can be seen in FIG. 4, when the cover is affixed on the vat, the tightening collar 4 bends back hip-lead 9 by pressing it against the lower surface 13 of edge 3, which improves both the retention of the cover on the vat and the sealing of the closure, without necessitating a separated joint such as an elastomeric ring.

In the direction of the center from its edge 8, crown 5 has a wavy or fluted profile in a manner so as to present exterior reinforcements which serve as a grip for the manipulation or the piling of the vats. In the present case, these reinforcements comprise a circumferential groove 14 and a circular hollow row 15. In addition to a rigidifying function of the cover, these reinforcements also make it possible to concentrically maintain piled vats, by cooperating with the corresponding projections provided on the bottom of the vats.

The zone of central orifice 6 of crown 5 is positioned in a truncated conical reinforcement surrounded by an oblique surface 16 of the upper surface of the crown. In the present case, this surface comprises a continuous circular spur 17 or a circular row of spurs of the same type. In the direction of the center it is followed by a horizontal support surface 1B, then an oblique surface 19 above an inclined edge 20 which surrounds the central orifice 6 and which presents a live edge 21. The edge 20 is relatively flexible with respect to the adjacent zones of crown 5. For example, it can be thinner than the adjacent zones, or be divided by radial slots.

The inner capsule 7 shown in cross-section in FIG. 3 is particularly adapted to cooperate with the interior edge of crown 5 such as is described above. This inner capsule has the shape of a rigid disk whose edge 22 is somewhat flexible and a flattened shape slightly curved towards the bottom in the rest state. The lower surface of the inner capsule comprises, within curved portion 22, a substantially cylindrical edge having an exterior hooked profile 24 and an oblique frontal surface 25. In the present case edge 22 and edge 23 are continuous, but one or the other could be subdivided by radial notches so as to be more flexible. Of course, the central portion of the inner capsule 7 is not necessarily flat as is shown and it can comprise for example rigidifiers, a handle, or furthermore inscriptions relating to the contents of the vat.

The inner capsule 7 is adapted to be affixed on the crown 5 in two different positions which are illustrated respectively to the left and to the right of FIG. 4. To the left, inner capsule 7 is affixed in a removable manner, in a position called provisional, which is useful essentially when the cover need not support a pressure coming from the interior of the vat, i.e., specially before the filling of the vat. In this position, inner capsule 7 is placed opposite with respect to its definitive position, the edge 23 being directed upwardly. When one pushes lightly downwardly on the inner capsule 7 in this position, its edge 22 engages under spur 17 by virtue of the elasticity of crown 5 and edge 22, which then maintains the back of the inner capsule resting against the horizontal surface 18 of the crown, and thus closes orifice 6 in a sufficiently sealed manner to prevent the entrance of dust or humidity. The inner capsule 7 can be affixed to the crown 5 in this position directly by the manufacture of the cover then this finished cover can be affixed on the empty vat by means of the tightening collar 4, for example by the manufacture of the vat, which facilitates the storage and the transport and makes it possible to preserve the cleanliness of the interior of the vat. At this stage, it will be noted that edge 23 is positioned in a recess of the cover, such that it does not disturb and it does not risk being damaged. Of course, inner capsule 7 can also be delivered separately, in particular if it carries signs characteristic of the future of the contents of the vat.

One can easily remove cover 7 from the provisional position, for example, by gripping it by its edge 23 and pressing on the oblique surface 16 of the crown to remove from spur 17 the edge of the inner capsule. This operation can be performed manually, but it can also be executed mechanically in a filling line of the vats.

After having been turned over, the inner capsule 7 can be replaced on orifice 6 and be brought, by a simple downward pressure, to its blockage position which is shown in the right portion of FIG. 4 and which, in the present example, is its definitive position. In its descending movement, the inner capsule is centered approximately by virtue of the conical shape of surface 16. At this stage, the frontal oblique surface 25 of edge 23 rests against the oblique surface 19 of edge 20 of the crown, which on the one hand perfectly centers the inner liner and on the other hand flexes edge 20 towards the exterior until hook 24 has gone beyond this edge, which stands up then by elasticity to rest engaged definitively in this hook. At the same time, the curved edge 22 of the inner capsule rests on the horizontal surface 18 of the crown and deforms elastically until it is practically flat. It thus remains tightly pressed against surface 18 when the inner capsule is in the blockage position, which assures on the one hand a permanent tightening in the hook 24 and on the other hand an excellent sealing between the inner capsule 7 and crown 5, even without an intercalated joint. One sees likewise that this closure can be very easily executed mechanically, since it suffices to displace and press downwardly the inner capsule which centers itself and blocks itself automatically in orifice 6.

Figure 5:
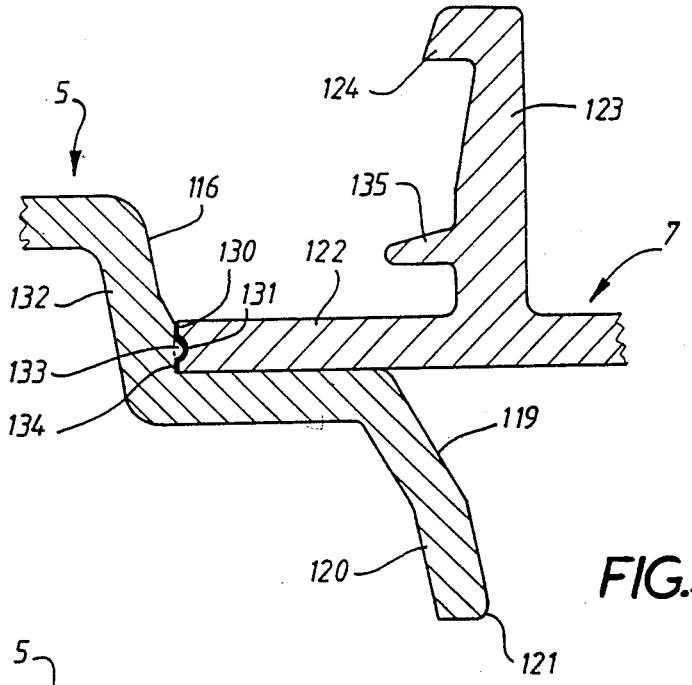
FIG. 5 is a detailed view in radial cross-section, showing another embodiment, the inner capsule being placed in its provisional position.
Figure 6:
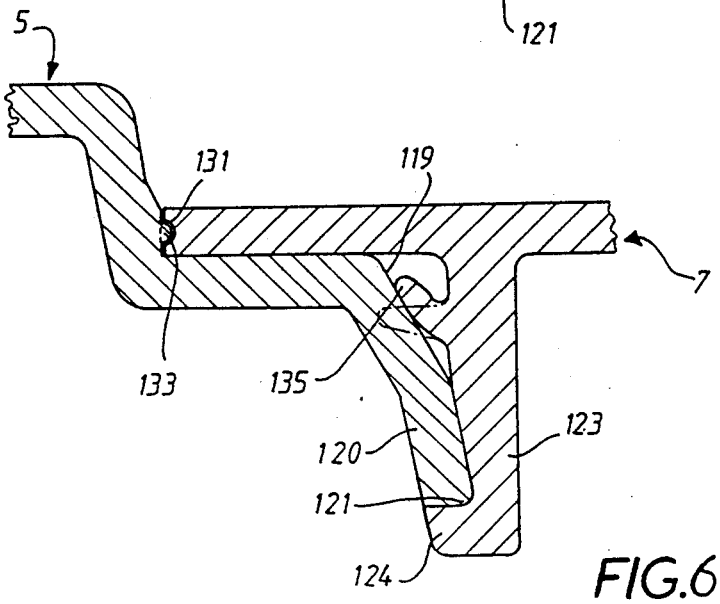
FIG. 6 is a view analogous to FIG. 5, showing the liner in its blockage position.

FIGS. 5 and 6 illustrate an embodiment in which crown 5 and inner capsule 7 have a shape generally similar to that of the preceding example, but comprise somewhat different sealing means and blockage means. The constructional elements which play the same role as those of the preceding example carry the same reference numeral increased by one hundred. In this case, the edge 122 of the inner capsule 7 is flat. On its side 130 is provided a central groove 131 which completely surrounds the inner capsule. With respect to this groove, a truncated conical portion 132 of crown 5 has a plurality of beads having a rounded profile 133 which are distributed on the periphery of a cylindrical surface 134 of the crown, below the oblique surface 116 which serve to center the inner capsule. It suffices to have three or four beads 133 on the periphery of the surface 134 to maintain the inner capsule 7 in its provisional position illustrated by FIG. 5. It suffices to press on inner capsule 7, placed oppositely, to obtain a ratcheting of the beads 133 in the groove 131, by virtue of the radial elasticity of the portion 132 of the crown. Conversely, to lift the inner capsule, one pulls it upwardly by gripping its edge 123, as in the preceding example.

After turnover, the inner capsule 7 can easily be placed in the blockage position on crown 5, as is seen in FIG. 6, simply by virtue of a pressure in the downward direction until the hook 124 of its edge 123 hooks on edge 121 of the interior edge 120 of the crown 5. As in the preceding example, the edge comprises a truncated conical surface 119 against which the hook 124 rests by descending, in a manner so as to radially flex the edge 120 and/or the edge 123. This edge likewise comprises, on its exterior surface, a flexible sealing tongue 135 which is pressed elastically against the oblique surface 119 when the inner capsule 7 is in its blockage position illustrated by FIG. 6. In this position, beads 133 are lodged likewise in the groove 131 of the edge of the inner capsule.

One can imagine other embodiments of the blockage means of the inner capsule, without going beyond the scope of the present invention. For example, so as to avoid having to turn over inner capsule 7 to pass from its provisional position to its blockage position, one can give a different shape to the interior edge 20 of crown 5, by forming on its surface hollows in which respective hooks 24 of the inner capsule can be engaged in a reversible manner to define the provisional position of the inner capsule, this one being thus able to be removed by a simple traction from the outside. Between these hollows, the edge of the crown can comprise cut-outs in which the hooks can elastically engage in a definitive manner by blocking the inner capsule such that it resists a pressure from the interior of the vat. One can provide guide paths of the hooks between each hollow and the adjacent cut-out, such that one can make the inner capsule pass from the provisional position to the blockage position by making it turn around its axis, according to a bayonet assembly principal. In one alternative embodiment, the cut-outs defined above can be replaced by appropriate recesses having a lateral ramp which makes it possible to liberate the hooks from the blockage position, by a reverse rotation of the inner capsule which one can thus remove, then to re-place and again block as many times as one wants. In this case, it is no longer necessary to be able to open the cover by likewise removing crown 5. This crown can then be replaced by a fixed crown (not shown) which is fixed to remain on the edge of the vat, by crimping. This embodiment makes it possible to do without the tightening collar, as well as to form vats with a cover which are less expensive and have a good sealing.

I claim:

1. A cover for a conditioning vat of bulk goods, said cover comprising a exterior crown provided with an orifice that is adapted to be affixed to said vat, a rigid inner capsule that is adapted to be applied and affixed to said orifice so as to block it, and means for blocking said orifice with said inner capsule, said blocking means having hooks, positioned on said inner capsule and on said crown and engaging by elasticity to maintain said inner capsule in a blockage position on said crown in a manner so as to prevent a disengagement of said inner capsule under the effect of a force directed towards the exterior of said vat, wherein said inner capsule and crown comprise means for sealing, said inner capsule on said orifice of said crown in a removable manner, said sealing means comprising at least one spur positioned around said orifice on an upper oblique surface of said crown in a manner so as to engage an edge portion of said inner capsule in a provisional position, and allowing for a disengagement of said inner capsule by a force directed towards the exterior of said vat, in a provisional position of said inner capsule where said blocking means are not engaged.

2. The cover according to claim 1, wherein said inner capsule, in its provisional position, is positioned opposite with respect to its blockage position.

3. The cover according to claim 1, wherein said inner capsule comprises at its periphery said edge portion said edge portion being substantially flat, said inner capsule extending radially beyond said blocking means and cooperating with said sealing means.

4. The cover according to claim 3, wherein said sealing means comprises a circular groove provided in a side of said edge portion of said inner capsule, and a bead adapted to be engaged in said circular groove, at least in said provisional position of said inner capsule and positioned on a zone of said crown which is elastically radial.

5. The cover according to claim 1, wherein said blocking means comprises an edge on said inner capsule, said edge having a hooked profile directed towards the periphery of said inner capsule in this hook when said inner capsule is in said blockage position, and in that said edge of said inner capsule and/or said interior edge of said crown are elastically deformable for the attachment of said inner capsule.

6. The cover according to claim 5, wherein said crown comprises an oblique surface above said interior edge, and said edge of said inner capsule comprises a flexible sealing tongue which is elastically applied against said oblique surface when said inner capsule is in said blockage position.

7. The cover according to claim 1, wherein said crown and said inner capsule are made of a synthetic, rigid and molded material.

8. The cover according to claim 7, wherein said exterior edge of said crown comprises a rigid portion that is adapted to be nested on said exterior surface of said extreme edge of said vat and a thinner and flexible portion extending at rest in an extension of said rigid portion which is adapted to be folded back against said edge of said vat by a tightening collar.

9. The cover according to claim 1, wherein said cover is circular.

* * * * *

UNITED STATES PATENT AND TRADEMARK OFFICE

CERTIFICATE OF CORRECTION

PATENT NO. : 4,932,549

DATED : June 12, 1990

INVENTOR(S) : Bernard GOUTTEFANGEAS

It is certified that error appears in the above-identified patent and that said Letters Patent is hereby corrected as shown below:

On the title page, in the Abstract, line 13, change "good" to --goods--.
Column 1, line 23, after "materials" insert --.--.
Column 1, line 38, after "closure" insert --.--.
Column 1, line 66, before "cover" delete "the".
Column 3, line 6, change "cover, 1" to --cover 1,--.
Column 3, line 11, delete "of".
Column 3, line 25, after "function" insert --.--.
Column 3, line 56, change "1B" to --18--.
Column 4, line 14, change "provisional" to --"provisional",--.
Column 6, line 7 (claim 1, line 2), change "a" to --an--.
Column 1, line 68, change "mutual a far" to --a means for--.
Column 2, line 12, change "comprise" to --comprises--.
Column 2, line 20, after "engage" delete --in--.
Column 2, line 20, after "least" insert --in--.
Column 2, line 24, change "is" to --are--.
Column 4, line 16, change "specially " to --especially--.
Column 5, line 21, change "ratchetng" to --sealing--.
Column 5, line 59, change "principal" to --principle--.
Column 6, line 8, (claim 1, line 13), after "sealing" delete ",".
Column 2, line 23, change "liner" to --capsule--.

Signed and Sealed this

Fourth Day of May, 1993

*Attest:*

Michael K. Kirk

MICHAEL K. KIRK

*Attesting Officer*

*Acting Commissioner of Patents and Trademarks*